United States Patent [19]

Loch et al.

[11] Patent Number: 4,517,059

[45] Date of Patent: May 14, 1985

[54] AUTOMATED ALTERNATING POLARITY DIRECT CURRENT PULSE ELECTROLYTIC PROCESSING OF METALS

[75] Inventors: David M. Loch, Seattle; Dale D. Henkes, Kent, both of Wash.

[73] Assignee: The Boeing Company, Seattle, Wash.

[21] Appl. No.: 289,105

[22] Filed: Jul. 31, 1981

[51] Int. Cl.[3] ..... C25D 5/18; C25D 11/02

[52] U.S. Cl. ..... 204/14.1; 204/23; 204/56 R; 204/58; 204/228; 204/DIG. 9; 364/500

[58] Field of Search ..... 204/14 R, 23, 228, 56 R, 204/58, DIG. 9; 364/500

[56] References Cited

U.S. PATENT DOCUMENTS

| | | | |
|---|---|---|---|
| 2,558,090 | 6/1951 | Jernstedt | 204/205 |
| 3,577,335 | 5/1971 | Blitchington | 204/228 |
| 3,669,855 | 6/1972 | Smith | 204/58 |
| 3,674,659 | 7/1972 | Livermore et al. | 204/56 R |
| 3,708,407 | 1/1973 | Newman et al. | 204/56 |
| 3,723,257 | 3/1973 | Bhattacharyya | 204/15 |
| 3,738,927 | 6/1973 | Miller | 204/228 |
| 3,892,636 | 7/1975 | Kaneda et al. | 204/35 N |
| 3,929,593 | 12/1975 | Sugiyama et al. | 204/35 N |
| 3,975,254 | 8/1976 | Elco et al. | 204/228 |
| 4,009,091 | 2/1977 | Washington et al. | 204/228 |
| 4,011,152 | 3/1977 | Rodrigues-Martinez | 204/228 |
| 4,026,781 | 5/1977 | Newman et al. | 204/228 |

FOREIGN PATENT DOCUMENTS

| | | | |
|---|---|---|---|
| 53-37542 | 4/1978 | Japan | 204/DIG. 9 |

*Primary Examiner*—G. L. Kaplan
*Assistant Examiner*—William T. Leader
*Attorney, Agent, or Firm*—Schwartz, Jeffery, Schwaab, Mack, Blumenthal & Koch

[57] ABSTRACT

Disclosed is a method and apparatus for electrolytic processing of a metal surface which, in a preferred embodiment, is anodization of an aluminum or aluminum alloy surface. An apparatus and method is provided which automatically senses the process voltage applied to the surface to be anodized and adjusts the duration of anodizing current pulses accordingly. Direct current anodizing pulses are interrupted by non-anodizing pulses which may be either zero current or reverse current pulses. The ratio of anodizing to non-anodizing pulse power is varied during anodizing such that the anodizing to non-anodizing time power ratio is reduced. In a preferred embodiment, a microprocessor follows the process voltage necessary to maintain a constant current flow to the metal surface and reduces the anodizing to non-anodizing time power ratio in a predetermined manner.

29 Claims, 12 Drawing Figures

Fig. 2A PRIOR ART
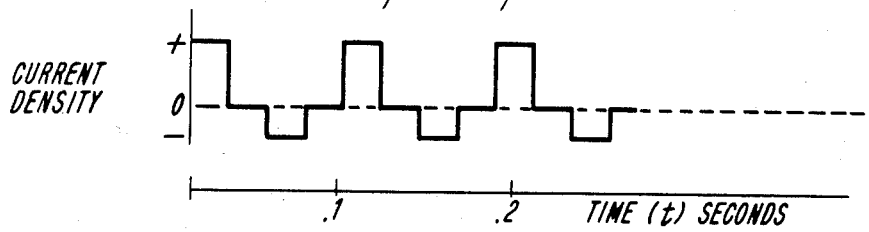
Fig. 2B
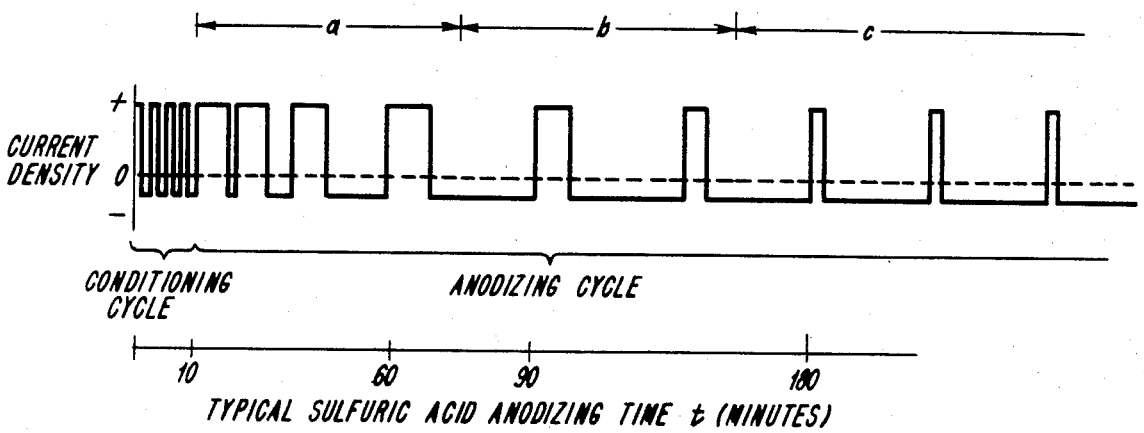
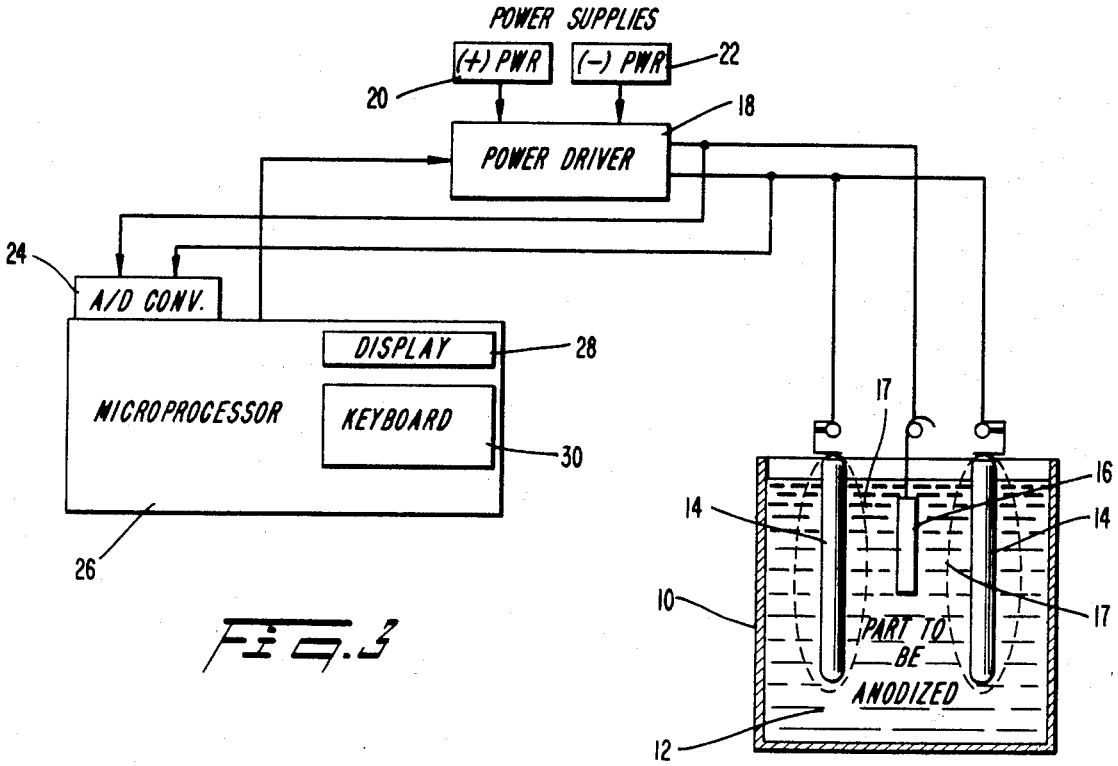
Fig. 3

POSITIVE POLARITY D.C. POWER SUPPLY
20
101
100
Vp
PART 16
CATHODE 14
201
200
NEGATIVE POLARITY D.C. POWER SUPPLY
22
18
POWER DRIVER
0
NC
120 VOLT A.C. SOURCE
FROM 120 VAC. SOURCE
F1
S1
NE1
62
60
34
MICROPROCESSOR POWER SUPPLY
-15 0 +5 +15 11.5 VAC
32
Q2
R10 430Ω
X
Y
RELAY COIL K1
D4
R9 7.5K
R8 750
R11 4.7K
LED 1
LED 2
Q1
R7 100
U2A
BUFFER/RELAY DRIVER
36
24
A/D CONVERTER
R1 100Ω (2W)
R2 2450Ω (25W)
D4
D2
R3 15Ω (1/4 W)
IN
AD570JD
8
DATA BUS
DATA READY
CONVERT
OUT
VIM-1 MICROPROCESSOR
26

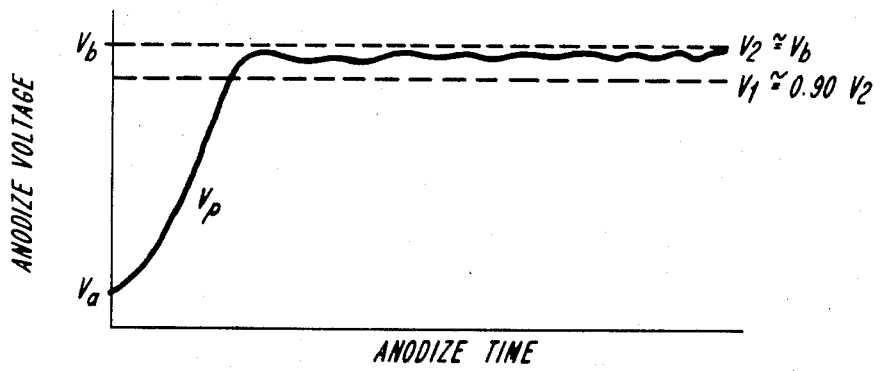
FIG. 9 SETTINGS FOR MAXIMUM COATING HARDNESS AND BUILD-UP RATE
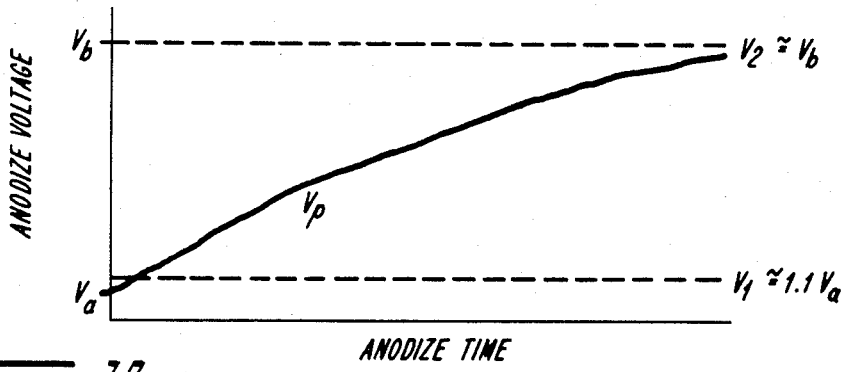
FIG. 10 SETTINGS FOR MAXIMUM SUBSURFACE COATING UNIFORMITY
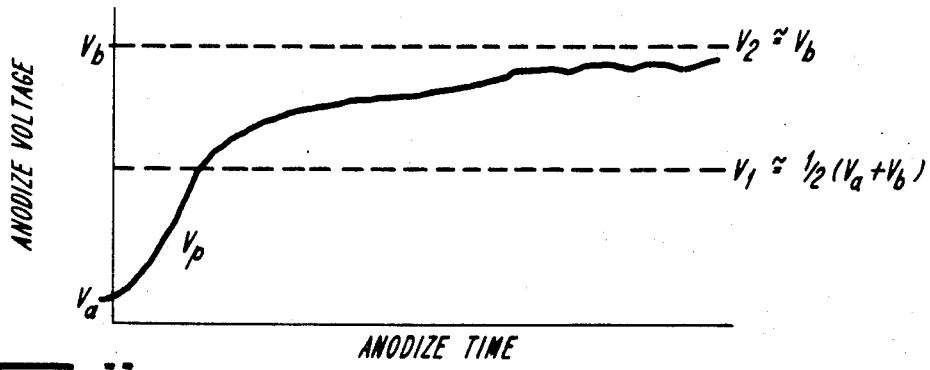
FIG. 11 SETTINGS FOR GOOD COATING HARDNESS, BUILD-UP RATE AND SUBSURFACE UNIFORMITY

AUTOMATED ALTERNATING POLARITY DIRECT CURRENT PULSE ELECTROLYTIC PROCESSING OF METALS

BACKGROUND OF THE INVENTION

The present invention relates generally to the electrolytic processing (anodizing, plating, etc.) of metals and specifically to the automated production of anodized coatings on aluminum, said coatings having superior hardness, thickness and a relative absence of surface and subsurface coating defects.

In the past it has been known that extensive process knowledge is necessary by an operator in order to rapidly generate thick, adherent and hard anodic coatings on aluminum and aluminum alloys. The basic process places the material to be coated in an acidic electrolyte and connects the material to the anode of a current source. An aluminum oxide coating will be formed on the aluminum material as current flows through the electrolyte and the material. The results of the anodizing process, such as the abrasion resistance, thickness, surface and subsurface coating defects, are the consequence of a number of different factors such as the chemistry of the electrolyte, electrolyte temperature, current density, the voltage excursion applied to the material and the aluminum alloy itself and temper thereof.

For example, using a sulfuric acid solution, low anodizing temperatures, ranging from 20° to 40° F., generally improve the abrasion resistance of the anodic coatings. However, low temperatures may reduce the anodizing rate and the maximum hard coating thickness obtainable with certain alloys such as 6061 depending upon the acid concentration and the current density utilized. In general, decreased temperatures increase the occurrence of local coating degradation known as "burning" which refers to a rapid and localized electrochemical milling of the part which renders the coating or part irreparable. Therefore, it can be seen that there is a trade off between coating abrasion resistance and the occurrence of burning when one chooses the electrolyte temperature. At temperatures above 50° F., unacceptable, powdery anodic coatings are produced in many cases. However, with certain alloys (including 6061), hard anodic coatings are produced with an increase in anodizing rate depending upon the acid concentration and the current density utilized.

The processing current density also greatly influences the anodic coating abrasion resistance, anodizing rate and burning tendency. Constant current densities greater than 50 amperes per square foot produce powdery or burned coatings on most aluminum alloys, yet current density just below this limit produce the highest anodizing rate, depending again upon acid concentration and temperature. This general rule is complicated because heat treatments which increase the aluminum alloy hardness beyond the T6 condition, typically require even higher current densities for proper anodization, depending upon the alloy.

The acid concentration will always diminish during anodization. The operator must learn, from experience, how to compensate for the resultant effects. Additionally, as the coating thickness increases beyond about two mils, the anodizing rate generally becomes relatively slow and the coating abrasion resistance will decrease. Consequently, the operator of anodizing equipment needs much experience and extensive process knowledge in order to do an acceptable job. Table I is a summary of coating effects caused by variations in the anodization process parameters.

TABLE I

| | Process Response Trends | | | |
|---|---|---|---|---|
| | Coating abrasion resistance | Anodizing rate | Maximum hard coating thickness | Burning tendency |
| Decreased temperature | ↑ | ↑ or ↓ | ↑ or ↓ | ↑ |
| Decreased current density | ↑ or ↓ | ↓ | ↑ or ↓ | ↓ |
| Decreased acid concentration | ↑ or ↓ | ↓ | ↑ or ↓ | ↑ |

Where two opposite effects are given for a single parameter change, the trend direction is dependent upon the particular aluminum alloy and/or its heat treatment and/or the values of other anodizing parameters.

Other factors which are related to the above are the coating breakdown voltage ($V_b$), the time dependence of the process voltage (V(t)) and the anodizing time (t). The coating breakdown voltage is defined as that alloy dependent voltage at which "burning" occurs. If the process voltage is maintained below the coating breakdown voltage, the coating thickness will be limited only by acid dissolution and degradation of the coating itself. These effects become more pronounced as the process voltage increases since heat is generated at the anodized surface in proportion to the power applied (the product of current and voltage). Therefore a low anodizing voltage is desired in order to maximize the coating abrasion resistance of any alloy.

Although $V_b$, V(t) and t characterize the hard anodizing process, there is great difficulty in controlling V(t). The process voltage exponentially increases with respect to an increasing coating thickness (given a constant current). This increasing voltage in turn increases the power dissipated during the anodizing process which increases the localized heating, dissolution and degradation of the anodic coating. Therefore, it is desirable to control the hard anodizing voltage without damaging the coating abrasion resistance.

Alternating the anodizing current waveform during the anodizing process is well known and is disclosed in U.S. Pat. No. 3,983,014 to Newman, et al., entitled "Anodizing Means and Techniques". This variable polarity anodizing process solved a number of the conflicting problems and provided greater coating thickness at higher anodizing rates. Unfortunately, the above process has very short duration pulses and requires continuous operator attendance. The results were not readily reproducible because of the crude voltage control available. Also, no general technique was determined which would rapidly generate thick, adherent and hard anodic coating on all aluminum alloys.

Unless this variable polarity anodizing process is used, the anodizing voltage will, when uncontrolled, exceed the coating breakdown voltage after approximately forty minutes of processing. Consequently, the coating thickness is limited and unacceptable coatings or damaged parts are unavoidable unless the process is terminated after a relatively short anodizing time. As noted earlier, the coating properties are highly dependent upon the anodizing voltage itself. At first blush, it would appear that simply using a voltage controlled power supply would solve the above problems. However, as the dielectric coating thickness increases, there is an increasing voltage requirement to maintain the current flow in the process. If the current is allowed to diminish, the increased processing time in the acid electrolyte will degrade the coating abrasion resistance below acceptable standards (in particular, below MIL-A-8625 standards).

In attempting to optimize the hard anodization process for various alloys, it has been found that one pattern of waveform alterations (as in the variable-polarity anodizing process) produced favorable results with one aluminum alloy, but gave poor results with other alloys. Further, the coating breakdown voltage varies widely depending on the alloy being anodized. Consequently, the utilization of a set pattern of current waveform alterations gives uniformly poor results. Furthermore, it would be too costly to experimentally determine the proper individual waveform alteration pattern for each different alloy to be anodized.

SUMMARY OF THE INVENTION

In view of the above prior art difficulties, it is an object of the present invention to provide an automated process with improved voltage control in order to allow rapid electrolytic processing of metals to the maximum anodization coating thickness desired.

It is a further object of the present invention to provide a method of maintaining anodizing voltage below the coating breakdown voltage without substantially reducing the anodizing rate for electrolytic processing of any aluminum alloy.

It is an additional object of the present invention to modify the variable polarity anodizing process such that the current waveform is altered either in amplitude and/or duration in order to maintain the anodizing voltage below the coating breakdown voltage while maintaining a high anodizing rate.

It is a still further object of the present invention to provide an apparatus for controllably reducing the time ratio of forward-to-non-forward power applied to the product to be anodized.

A further specific object of the present invention is to provide a method of process voltage feedback and process control by electronically monitoring process voltage with present current levels and automatically adjusting the positive and negative polarity current pulse durations during a process cycle.

It is a still further object of the present invention to provide a computerized pre-programmable and highly reproducible process voltage feedback and process control response in order that the resultant products, produced by electro-chemical means, may be highly reproducible.

Another specific object of the present invention is to provide a computerized and pre-programmable method such that the active range of process voltage feedback is adjustable and the response of the process control to the voltage feedback is dynamically adjustable.

It is a further specific object of the present invention to provide an automated anodize process controller utilizing alternate polarity direct current pulses of long duration to rapidly generate thick, adherent and hard anodic coatings on aluminum and its alloys.

An additional specific object of the present invention is to improve the abrasion resistance, thickness and relative absence of subsurface defects in anodic coatings by subjecting the work to be anodized to a "conditioning cycle" of a fixed, but pre-programmed cycle of positive and negative polarity pulses of high current, followed by an "anodizing cycle" in which the current waveform is regulated by process voltage feedback and dynamic computerized process control.

It is a still further specific object of the present invention to utilize conventional anodizing tank setups and ripple filtered or unfiltered direct current power supplies by installation of the automated process hardware, thereby avoiding new acquisition and salvage costs of major process components.

The above and other objects are achieved in monitoring the process voltage and adjusting the current waveform based thereon. The current waveform is set by a waveform controller which maintains the process voltage below the coating breakdown voltage enabling a thick, adherent hard anodic coating to be generated on any or all alloys.

In one preferred embodiment, a microprocessor determines the duration of forward (anodizing) and reverse (non-anodizing) current pulses which are applied to the subject alloy. Current densities of the positive polarity pulses range from 20 to 70 amperes per square foot and the negative pulses range from 0.0 to 20 amperes per square foot. The duration of forward pulses may range from 60 seconds to 0.5 seconds and the duration of negative pulses when utilized may range from 0.5 seconds to 300 seconds. The durations of the positive and negative pulses (when utilized) as well as their amplitudes may be varied during operation in accordance with the microprocessor instruction based upon the anodizing voltage. The above method and apparatus to achieve this method provide hard anodized coatings having thicknesses in the range of from 2 to 5 or more mils with a superior hardness characteristic and are relatively free from coating defects such as cracks, pits and voids. The automated aspect of the process eliminates the extensive process knowledge and experience required for an operator to form the necessary thick, adherent and hard oxide coating on all aluminum alloys.

BRIEF DESCRIPTION OF THE DRAWINGS

A more complete appreciation of the invention and the attendant advantages thereof will be more clearly understood by reference to the following drawings, wherein:

FIGS. 2*a* and 2*b* are graphs of current density versus time for anodization cycles in accordance with the prior art and the present invention, respectively;

FIG. 3 is an electrical block diagram of the present invention;

FIGS. 9–11 are graphs of anodize voltage versus anodize time showing preferred controller settings and typical voltage profiles for specifically desired results.

DETAILED DESCRIPTION OF PREFERRED EMBODIMENTS

Figure 1:
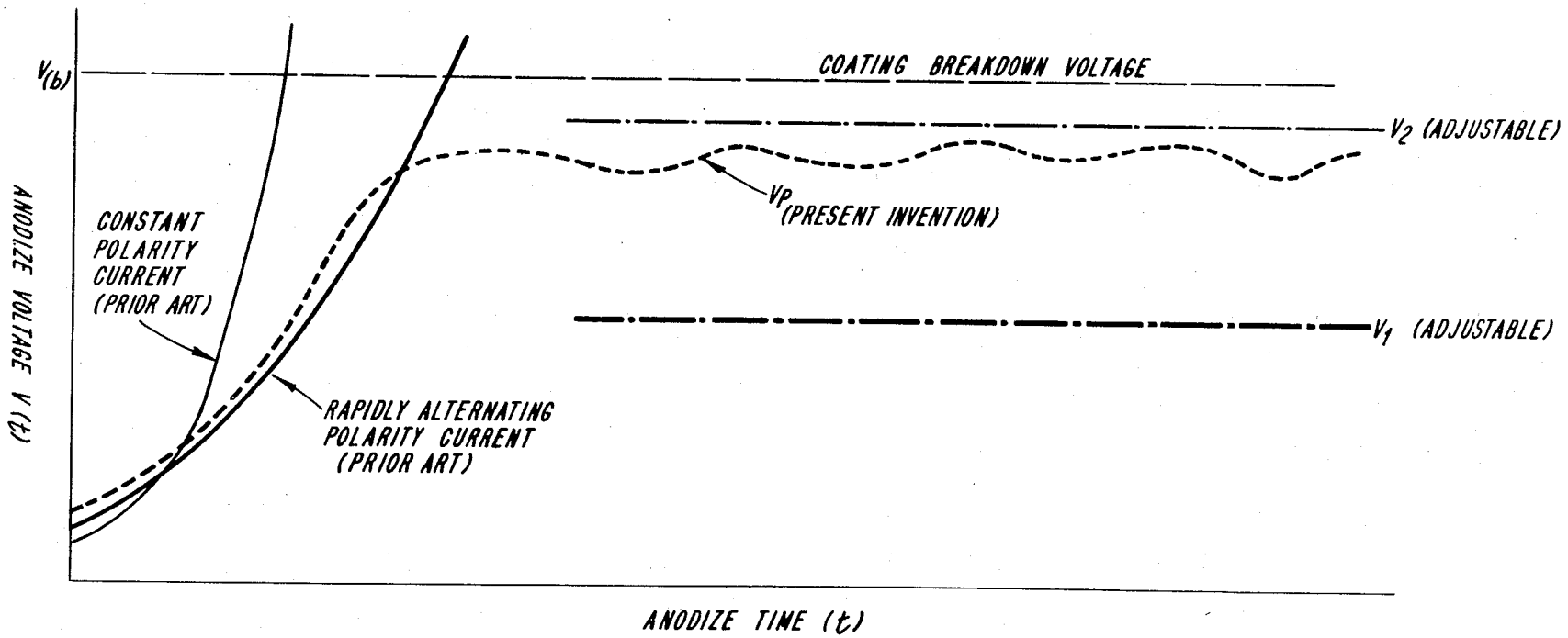
FIG. 1 is a graph of anodize voltage versus anodize time comparing prior art curves with a curve according to the present invention.

Reference may be had to the drawings wherein like reference characters designate like parts throughout the several views. In understanding the present invention a brief review of the problem and its causes as discovered by the applicant may be helpful in understanding how the applicant's invention overcomes these problems.

In the development of the present invention, it has been observed that the coating breakdown voltage ($V_b$), the process voltage excursion V(t) and the anodizing time (t) exhibit straightforward relationships between the seven parameters in Table I. These relationships greatly simplify the hard anodize process knowledge.

For example, it was observed that there is a characteristic peak voltage at which an anodic coating will break down and burn or become powdery during a given process cycle. This peak voltage may be called the coating breakdown voltage. Furthermore, it was observed that, for a given alloy and heat treatment, the coating breakdown voltage ($V_b$) is relatively constant regardless of anodizing conditions. Therefore, it was observed that if the process voltage excursion V(t) could be maintained below the coating breakdown voltage $V_b$, then the maximum anodic coating thickness could be obtained on any substrate and "burned" or powdery coatings could be avoided, regardless of anodizing conditions.

The process voltage excursion V(t) was observed to be characteristic for a given alloy and anodizing conditions. For long anodizing times, which are necessary to obtain thick coatings, it was observed that a high V(t) produced anodic coatings with less abrasion resistance, a slower anodizing rate and more subsurface coating defects than with coatings produced at a low V(t). The absence of subsurface coating defects is crucial, because this greatly affects the long-term abrasion resistance of anodic coatings.

Heat treatment and low acid concentrations were also observed to affect V(t). Increased aluminum alloy hardness beyond the −T6 condition or low acid concentrations generated voltage excursions V(t) which were flatter, with a lower rate of voltage increase, than with normal substrate hardnesses and acid concentrations. The resultant anodic coatings were usually soft or powdery. It was observed that if V(t) could be adjusted so that it was normal for the given alloy, the resultant coatings were acceptable.

Therefore, to obtain the desired results of high abrasion resistance, high anodizing rates and a minimum of coating defects, control of the process voltage excursion V(t) was the key.

Ultimately, regardless of substrate or anodizing conditions, a long anodizing time (t) was observed to cause acid degradation, softening and dissolution of anodic coatings. Therefore, it was observed that the anodizing time (t) must be minimized with respect to controlling V(t). Therefore, to rapidly generate thick, adherent and hard anodic coatings, the extensive process knowledge formerly required is reduced to the present invention techniques:

(i) Maintain V(t) below $V_b$
(ii) Maintain a low V(t)
(iii) Minimize t

As priority noted, it was previously appreciated that a voltage controlled power supply would provide the hard anodizing voltage control to practice the present invention techniques. However, as the dielectric coating thickness increases, there is an increasing voltage requirement to maintain current flow to the process. If the current is allowed to excessively diminish, the increased processing time in the acid electrolyte will degrade the coating abrasion resistance below acceptable standards. No known prior art processes can provide the proper process voltage control to practice the present invention techniques.

For example, the most obvious voltage control is to adjust the current density of a constant polarity current. Low currents provide the greatest voltage control. However, the attendant slow anodizing rate produces soft or powdery anodic coatings.

Another means of voltage control is to rapidly alternate the polarity of the process current on the order of 60 Hz or more. This technique is well known. It provides slightly more voltage control at a given current density and has reduced the burning tendency relative to using a constant polarity current. As previously noted, Newman discloses a further improvement in rapid polarity current alteration for anodizing. They proportioned the current between the two polarities such that the reverse (non-anodizing) current was smaller than the forward (anodizing) current. This has allowed higher anodizing current densities to be utilized, resulting in a higher anodizing rate over conventional rapid alternating polarity techniques, where the forward and reverse current magnitudes are the same. However, the Newman techniques of rapid polarity alternation cannot produce the voltage control required to practice the present invention. Furthermore, this kind of rapid polarity alternation, on the order of 60 Hz or more, typically generates more subsurface coating defects than a constant polarity current and the subsurface coating defects reduce the long-term abrasion resistance of the coatings.

In summary, no known prior art techniques have reduced the extensive process knowledge to hard anodization voltage control and no known prior art means can be used to carry out this control. FIG. 1 shows in solid lines the typical voltage control capabilities of prior art processes when attempting to apply the present invention techniques of voltage control. The prior art voltage curves uncontrollably climb to the coating breakdown voltage at which the coatings "burn" or become soft or powdery. Consequently, only weak control of anodizing time (t) is available while maintaining a high anodizing rate. FIG. 1 also shows in dashed lines the typical voltage control of the present invention. The process voltage rate of increase can be controlled between $V_1$ and $V_2$ and, the peak voltage can be indefinitely limited to $V_2$ while maintaining a high anodizing rate. Hence, V(t) and (t) can be fully controlled.

Theory of Operation

The theory of process voltage control and coating property improvement is based on improved cooling and degasing of the coatings during processing. During most hard-anodizing processes, a high density covering of gas bubbles will form on the cathode and the part being anodized. As the anodizing time increases, the volume of gas trapped in the coating also increases. Eventually, using conventional anodizing techniques, the coating becomes nearly saturated with gas from the anodizing reaction. This gas prevents electrolytes from reaching the reaction site (the coating/substrate interface), which consequently slows the anodizing rate and increases the process voltage (due to the low local concentration of reactants). Poor heat transfer through the gas saturated coating produces local overheating at the reaction site. This causes macro-structural deformation, voids, cracks and other subsurface coating defects.

On the coating surface, the high density covering of gas bubbles on the cathode and the part being anodized also contributes to the further increase in process voltage. The increased process voltage due to the gas saturation of the coating causes increased softening of the coating itself. In the presence of an acidic anodizing solution, resistive heating (current×voltage) accelerates coating dissolution and softening. Hence, the degree of coating softening via resistive heating is proportional to the volume of gas saturated in the coating.

The present invention utilizes direct current pulses of long duration of both forward and reverse (in a preferred embodiment) polarity in a specific manner in order to minimize the above gas saturation and cooling problem. Hereinafter, "reverse polarity" is used to mean a "non-forward polarity" pulse and includes time periods when no current is applied as well as reverse polarity periods which are preferred. During the forward polarity pulse, a larger current flows to the anodizing part and the resultant anodizing reaction generates a high density covering of gas bubbles on both the cathode and the part. During the reverse polarity pulse, a small current flows to the cathode and as a result, gas bubbles are discharged both from the cathode and the anodized coating itself. Therefore, the degree of gas saturation of the coating is dependent upon the duration of the forward and reverse pulses.

During anodization, the increases in the process voltage are directly proportional to the degree of gas saturation of the coating and the dielectric coating thickness. Because experience has indicated that the gas saturation of the coating is the largest factor in increasing the process voltage, any reduction in the degree of gas saturation will result in a reduction of the process voltage. As noted above, the degree of coating gas saturation is a function of the forward pulses and an inverse function of the reverse pulses. The particular method and apparatus for choosing the magnitude and duration of the forward and reverse pulses can now be discussed.

As the coating thickness increases, the duration of the reverse pulse must increase because of the longer gas path distance through the coating and its requisite longer degassing time. Practically, however, the reverse pulse durations must be limited in any anodization process because no anodizing occurs during this pulse. In fact, a zero current reverse pulse (in effect a pause in forward pulses) will operate to produce an acceptable coating although not a preferred embodiment. Additionally, excessive reverse pulse durations would produce powdery coatings due to acid degradation of the coating itself. It has been found that a gradual reduction in the forward pulse duration after a moderately long reverse pulse duration is reached will permit a continuing decrease in the forward/reverse pulse duration ratio without having reverse pulses of an excessive length.

In addition to degassing the coating, this application of alternating polarity current appears to generate a more porous coating which enables the coating to better degas and to provide a surface which can better retain lubricants. It should be noted that, if the reverse polarity current is too high, regardless of the reverse pulse duration, the coating tends to "seal" so that the gas cannot escape and thereby rapidly increase the anodizing voltage required to maintain a constant current.

It should further be noted that the decrease in the forward/reverse pulse duration ratio serves to cool the coating to a greater extent and as seen from Table I increases the coating abrasion resistance. Thus, knowing the theory of the operation of the present invention, a brief discussion of precisely how the applicant's invention implements the above theory will be undertaken.

Process Description

A comparison of the prior art current waveform with the waveform of the present invention is illustrated in FIGS. *2a* and *2b*. FIG. *2a* shows the variable polarity waveform as disclosed in U.S. Pat. No. 3,983,014 as noted earlier. A forward pulse of a fixed duration is followed by a slightly shorter reverse pulse of fixed duration in a periodic manner until either the desired coating thickness is reached or the coating breakdown voltage is reached. It should be noted that the duration of one complete cycle in the FIG. *2a* waveform is typically one-tenth of one second or less as opposed to waveform durations of fifteen seconds or more in the FIG. *2b* embodiment (for the anodizing cycle).

The present invention is characterized by two separate cycles—a conditioning cycle and an anodizing cycle. The conditioning cycle, which may last ten minutes, comprises short and constant duration pulses of both forward and reverse current which "condition" the aluminum surface in order to reduce the burning tendency of the part to be anodized. The anodizing cycle shown in FIG. *2b* is divided up into three phases—a, b and c, all of which include a reduction in the time ratio of forward to reverse power (current×voltage) applied. During phase a, the constant duration forward pulse is interrupted by an increasing duration negative pulse which in a preferred embodiment may be up to 5 minutes duration. In phase b, because the length of time of a reverse pulse is non-anodizing time, the reverse pulse length is maintained constant and the forward pulse duration is decreased. Finally, if further anodizing is necessary (in order to build up an extremely thick anodized coating), the pulse duration of the forward and reverse pulses are maintained constant and the amplitude of the forward current pulses is decreased. In many instances, phases b and/or c are unnecessary because a sufficiently thick anodized coat has been built up during phase a, but it is understood that phases b and/or c can be included with phase a. Furthermore, as long as the time ratio of forward to reverse power is decreasing as a function of the coating buildup, the precise phase utilized is not of critical importance. It seems clear that the magnitude of the reverse current flow could be increased while the forward current flow is constant or decreased in order to decrease the above-noted ratio. Furthermore, combinations of phases a, b and/or c could be altered to provide a greater and/or quicker decrease in the forward to reverse power ratio.

In the embodiment shown in FIG. *2b*, at the beginning of phase a, a maximum forward pulse may be applied for about 30 seconds followed by a reverse pulse applied for about 0.5 seconds. As the dielectric coating thickness increases, the process voltage also increases to maintain a constant current input. In order to control the process voltage, the forward and reverse pulse duration ratio is canged in accordance with microprocessor instructions which are dependent upon the present process voltage needed to maintain the current level.

Towards the end of the anodizing cycle, when the coating has attained its maximum thickness, the final current waveform is such that the forward pulse duration is at a minimum value, typically about 0.5 seconds, and the reverse pulse duration is at a maximum value, typically about 15 seconds. Additionally, the maximum forward pulse duration and maximum reverse pulse duration are not drawn to scale and reflect only relative changes in pulse durations of forward and reverse pulses.

As noted earlier, in many instances, the maximum coating thickness is not desired and in the preferred embodiment, the complete waveform alteration pattern shown in FIG. 2*b* is not required in order to control the process voltage. The process response to the microprocessor control is illustrated in FIG. 1 where $V_p$ is the process voltage applied between the cathode and the anodized part at any specific point in time. It should be understood that the excursion or variation of $V_p$ shown in FIG. 1 is purely illustrative and is intended only to depict the general automated voltage trend of a preferred embodiment. Voltage limits $V_1$ and $V_2$ are independently adjustable to control the process voltage excursions and thereby control the coating thickness and properties. $V_1$ is defined as the process voltage at which the microprocessor begins to alter the initially applied waveform by decreasing the forward/reverse power ratio (in a preferred embodiment, by increasing the negative pulse duration). $V_f$ (not shown) is a midpoint voltage between $V_1$ and $V_2$ at which the negative pulse duration is at a maximum and the positive pulse duration begins to decrease in order to continue decreasing the forward/reverse power ratio. This $V_f$ would correspond in time to the division between phase a and phase b in the anodizing cycle shown in FIG. 2*b*. $V_2$ is the process voltage at which the microprocessor would generate the final waveform configuration which would have the forward pulse at a minimum duration, typically 0.5 seconds and the reverse pulse at a maximum, typically 15 seconds. A reduction in anodizing current density could be utilized if the process voltage tended above $V_2$ by means of a suitable voltage limiting constant current controlled forward power supply.

A functional block diagram of one embodiment of the present invention is shown in FIG. 3 which includes a standard anodizing tank 10 containing a refrigerated and normally air-agitated electrolyte 12. Lead or graphite cathodes 14 are provided in the tank to complete the current flow path to the aluminum or aluminum alloy part 16 which is to be anodized. Where lead cathodes are used, it has been found that during operation, lead particles flake off of the cathode. A loose bag 17 of material unaffected by the electrolyte (such as "Dynel") can be arranged around the cathode to retain any lead particles. The cathodes 14 and the part to be anodized 16 are connected to power driver 18 which is supplied by positive (anodizing) and negative (non-anodizing) power supplies 20 and 22, respectively. An analog-to-digital converter 24 samples the voltage applied between the cathode and the part to be anodized and provides an input to the waveform generator and controller 26. The controller may include a visual display 28 and keyboard 30 for the display and input of control information, respectively.

According to one embodiment, the automated process would operate as follows: after power is initially turned on, the conditioning cycle is run for 10 minutes. After the end of the conditioning cycle, the anodizing cycle would start with the analog-to-digital converter 24 sampling the process voltage (at the preset conditioning cycle current density) and provide a digital indication thereof to the waveform generator and controller 26. The process voltage $V_p$ is compared relative to $V_1$, $V_2$ and $V_f$. Based on the comparison, a low current, binary signal will be sent to a buffer/preamp (not shown) for initial amplification and then to the power driver. The power driver in turn provides the high-voltage, high-current amplification of the buffer/preamp signal generating the output current waveform of FIG. 2*b* which is applied to the part 16. At the end of each forward pulse, the process voltage $V_p$ is sampled and the waveform generator and controller will make any alterations in current waveform which are necessary.

In a preferred embodiment, the waveform generator and controller 26 is a microprocessor such as a Model VIM-1 available from Synertek Systems Corp., P.O. Box 552, Santa Clara, Calif. 95052. The programming language utilized with this microprocessor is a low-level language described in the Synertek Systems VIM-1 Operating Manual, available from the above corporation. The following discussion will relate to the software description and flow charts which are used for programming the microprocessor to operate in the desired manner.

Software Description and Flow Charts

In general, the conditioning cycle waveform and the anodizing cycle waveform are generated exclusively by microprocessor software and can be easily changed or modified. The parameter ranges which have been found most suitable for the conditioning cycle are as follows: the cycle duration is 10 minutes with forward pulses and reverse pulses having a duration of from 1 to 10 seconds (the duration is fixed during the conditioning cycle). The anodizing cycle has a variable cycle time which is dependent on the time necessary to reach the desired coating thickness or to reach a process voltage limit of the coating breakdown voltage or available power supply voltage, whichever comes first. The cycle waveform will be discussed with regard to the waveform functions disclosed in FIG. 2*b* but as noted earlier, different cycle waveforms or combinations thereof could be utilized in accordance with the present invention by reprogramming the microprocessor to alter the automated process response.

The time of the positive pulse $T_{pos}$ is controlled by:

$$T_{pos} = T_p \times (V_2 - V_p) \text{ where } T_p = \frac{2(T_{pos})_{max}}{(V_2 - V_1)}$$

wherein $V_1$ is the minimum process voltage at which active process control begins, $V_2$ is the maximum process voltage (during most operations), and $V_p$ is the actual process voltage at any point in time. To select $V_1$ and $V_2$, $V_a$ and $V_b$, must be determined. $V_a$ and $V_b$ are dependent on the anodizing electrolyte used, electrolyte temperature, anodizing current density and aluminum alloy series. $V_a$ is the initial anodizing voltage at which the desired current density is provided. For sulfuric acid electrolytes, 36 to 40 amperes per square foot is a typical range of desired current density. $V_b$ is the maximum anodizing voltage at which the coating "burns" or becomes powdery.

To select $V_1$ and $V_2$, coating thickness, the relative absence of subsurface coating defects and coating buildup rate must also be considered because there are tradeoffs to be made. For example, FIG. 9 depicts settings for the production of coatings having maximum hardness at a maximum coating buildup rate. However, the relative absence of subsurface coating defects (i.e., coating uniformity) will not be optimal. FIG. 10 depicts the settings to produce coatings having maximum subsurface coating uniformity, at a reduction of buildup rate, and a reduction of coating hardness for very thick coatings.

Since the subsurface coating uniformity is related to the long-term abrasion resistance of a hard anodized piece, a compromise of settings and resultant coating properties might be desired. FIG. 11 depicts such a suggested compromise.

After $V_1$ and $V_2$ are selected, then $(T_{pos})_c$ and $(T_{neg})_c$ may be selected. $(T_{pos})_c$ is the fixed anodizing pulse, and $(T_{neg})_c$ is the fixed negative polarity pulse during the conditioning cycle. The conditioning cycle is an optional treatment for alloys that readily burn, such as the 2000 series aluminum-copper alloys. This conditioning treatment replaces the prior art method of conditioning at about half the anodizing current density for the first ten minutes or longer. The invention conditioning cycle enables one to run at full anodizing current density throughout the entire process cycle. For alloys with a low burning tendency, such as the 7000 series aluminum-zinc alloys, the conditioning cycle may be bypassed.

If the condition cycle is desired, using a sulfuric acid electrolyte, the ratio of $(T_{pos})_c$ to $(T_{neg})_c$ should be at least 10:1 for alloys such as 2000 series, with a high burning tendency. This ratio may be lower for alloys with a lower burning tendency than 2000 series. However, in any case, a $(T_{pos})_c/(T_{neg})_c$ ratio of at least 10:1 will be acceptable. After the process control parameters $V_1$, $V_2$, $(T_{pos})_c$ and $(T_{neg})_c$ are selected for a given anodize process and alloy series, they may be repeatedly used to rapidly and reproducibly generate anodize coatings having the desired properties on any heat treatment or any aluminum alloy in the given alloy series.

In a preferred embodiment, $T_{pos}$ ranges from 0.5 seconds to 60 seconds.

The time duration of negative pulse $T_{neg}$ is controlled by:

$$T_{neg} = T_n \times (V_p - V_1) \text{ where } T_n = \frac{2(T_{neg})\max}{(V_2 - V_1)}$$

with $T_{neg}$ ranging from 0.5 seconds to 300 seconds with $T_{neg}$ ranging from 0.5 to 15 seconds in a preferred embodiment. As can be seen from the FIG. 4 flow chart, preset or default conditioning cycle values for $(T_{neg})_c$ and $(T_{neg})_c$ as determined above, can be used or a specific conditioning pulse duration can be keyed into the microprocessor (for example, a longer conditioning positive pulse duration for 2000 series alloys). Additionally, although the flow chart is set up for a conditioning cycle of 10 minutes, this conditioning cycle duration could also be changed to a longer or shorter duration depending on the particular application.

Figure 4:
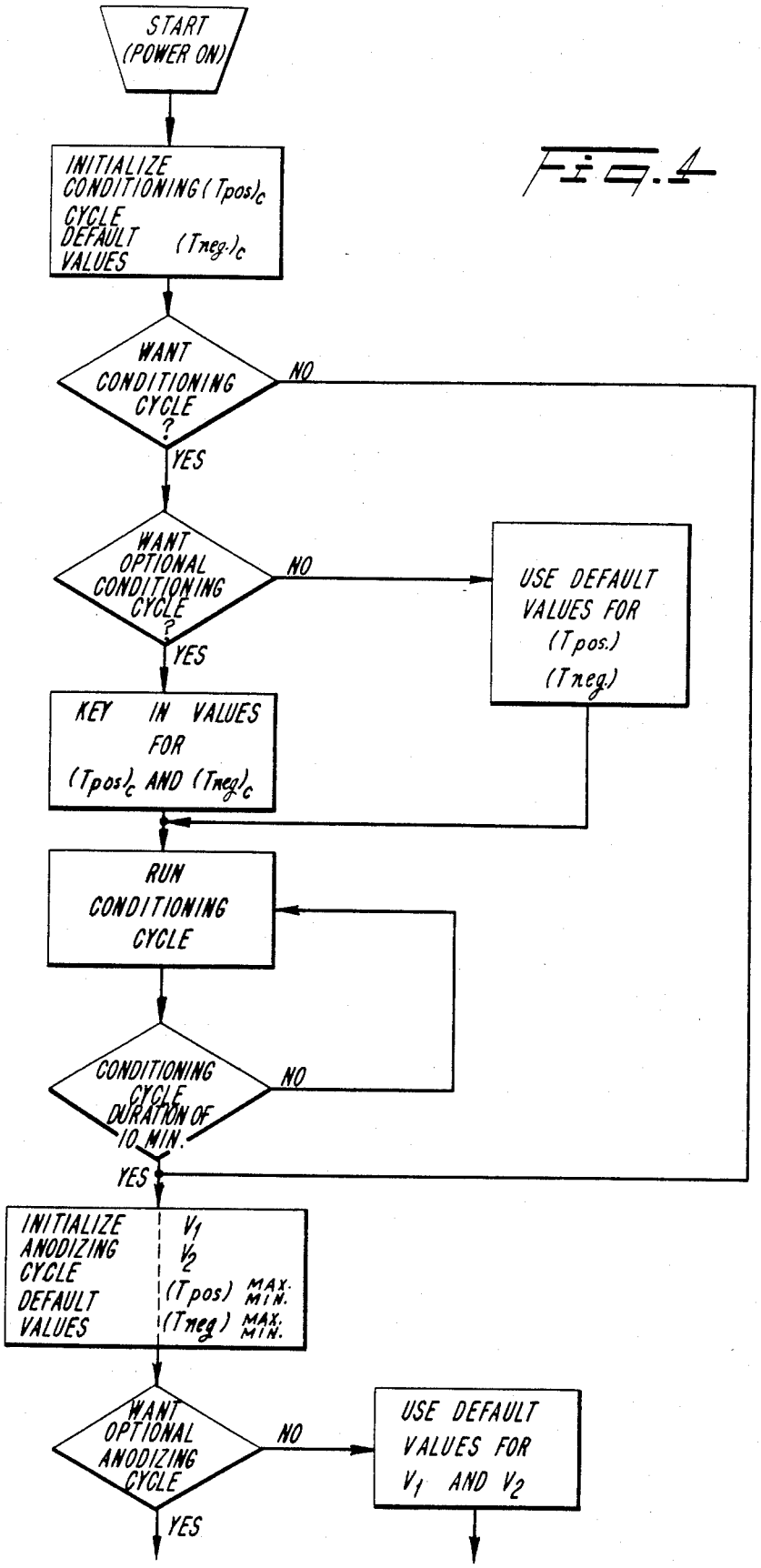
FIGS. 4–6 are flow charts depicting the control logic for the conditioning and anodizing cycles in accordance with one embodiment of the present invention.
Figure 5:
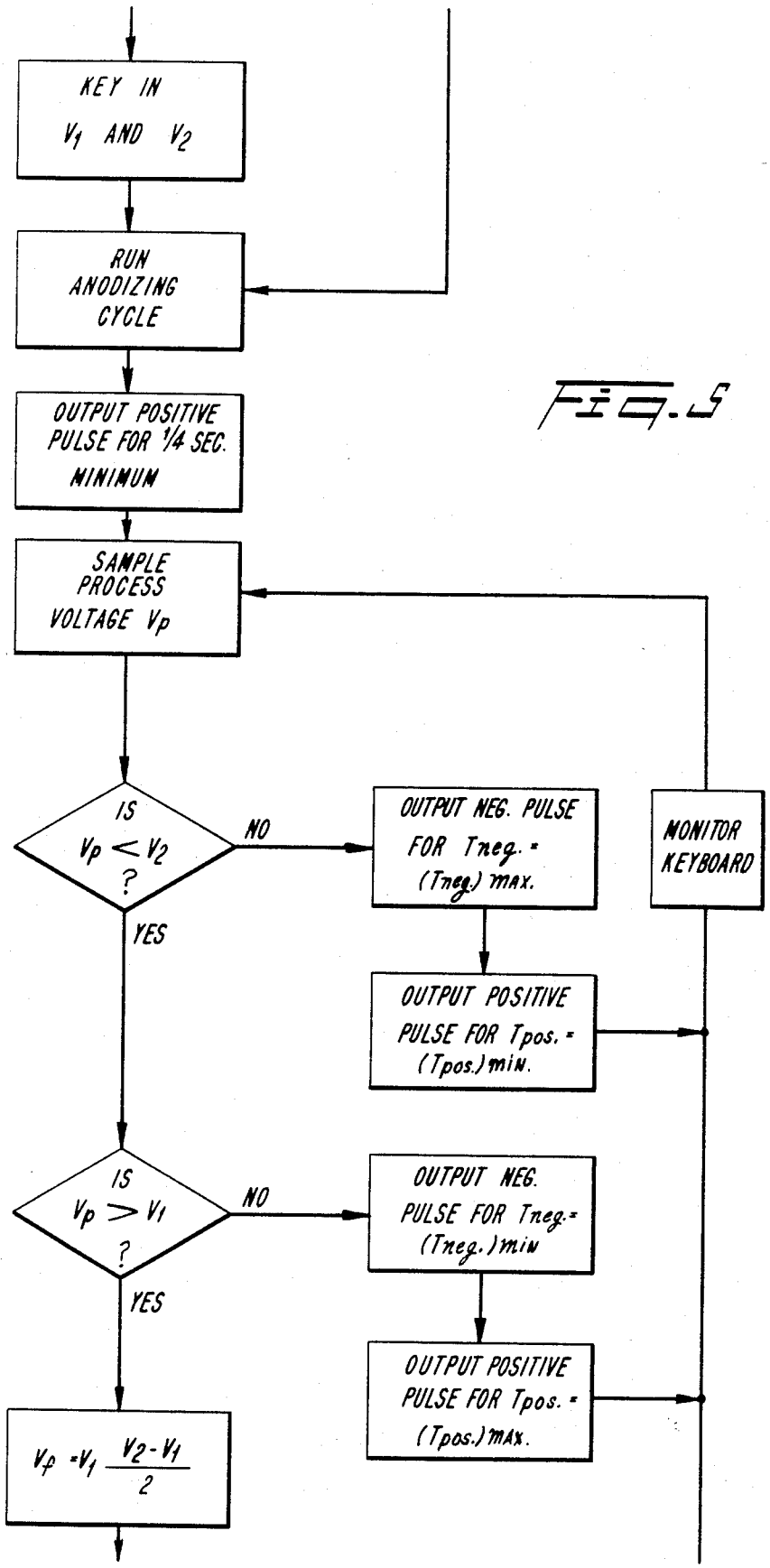
Figure 6:
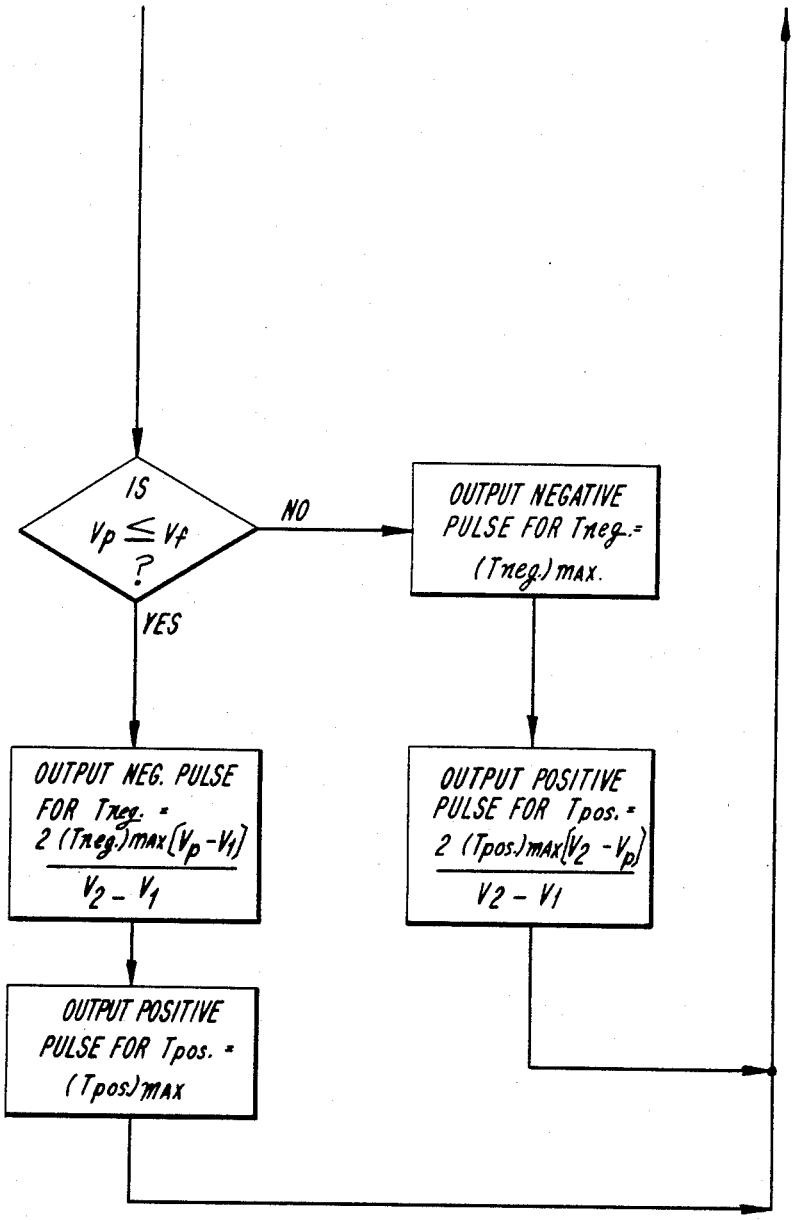

FIGS. 4–6 illustrate the microprocessor control logic of the anodizing cycle. As can be seen on FIG. 4, preprogrammed or default values for $V_1$, $V_2$, $(T_{pos})_{min}$, $(T_{pos})_{max}$, $(T_{neg})_{min}$ and $(T_{neg})_{max}$ can be used or specific values can be keyed into the microprocessor for an optional anodizing cycle. The rest of the flow chart figures for the anodizing program are relatively straightforward and the end result is that the waveform is initially maintained with a constant duration for forward pulses and an increasing duration for reverse pulses until a maximum reverse pulse duration is reached (as in the end of phase a of the anodizing cycle of FIG. 2*b*) which corresponds to the process voltage being greater than $V_1$ and less than $V_f$. When the maximum reverse pulse duration is reached and the process voltage reaches $V_f$, the forward pulse duration begins to decrease (corresponding to phase b of the anodizing cycle shown in FIG. 2*b*). Finally, when the process voltage is equal to $V_2$, the duration of the forward pulse is at a minimum and the current density amplitude of the forward pulse begins to decrease (corresponding to phase c in the anodizing cycle shown in FIG. 2*b*) if a voltage-limited, constant-current-controlled power supply is used. The flow chart figures do not illustrate the logic necessary to accomplish the phase c control although this would be obvious to one of ordinary skill in the art in view of using a voltage-limited power supply. Additionally, although not shown, a total anodizing time loop could be included as in the conditioning cycle to terminate the anodizing process. This could also be a function of the number of times $V_p$ is equal to or greater than $V_2$. Finally, a keyboard monitor program where a keyboard 30 is utilized with the waveform generator and controller 26 is not shown but would be obvious to one skilled in the art of interfacing keyboards and microprocessors.

Hardware Interconnection

Figure 7:
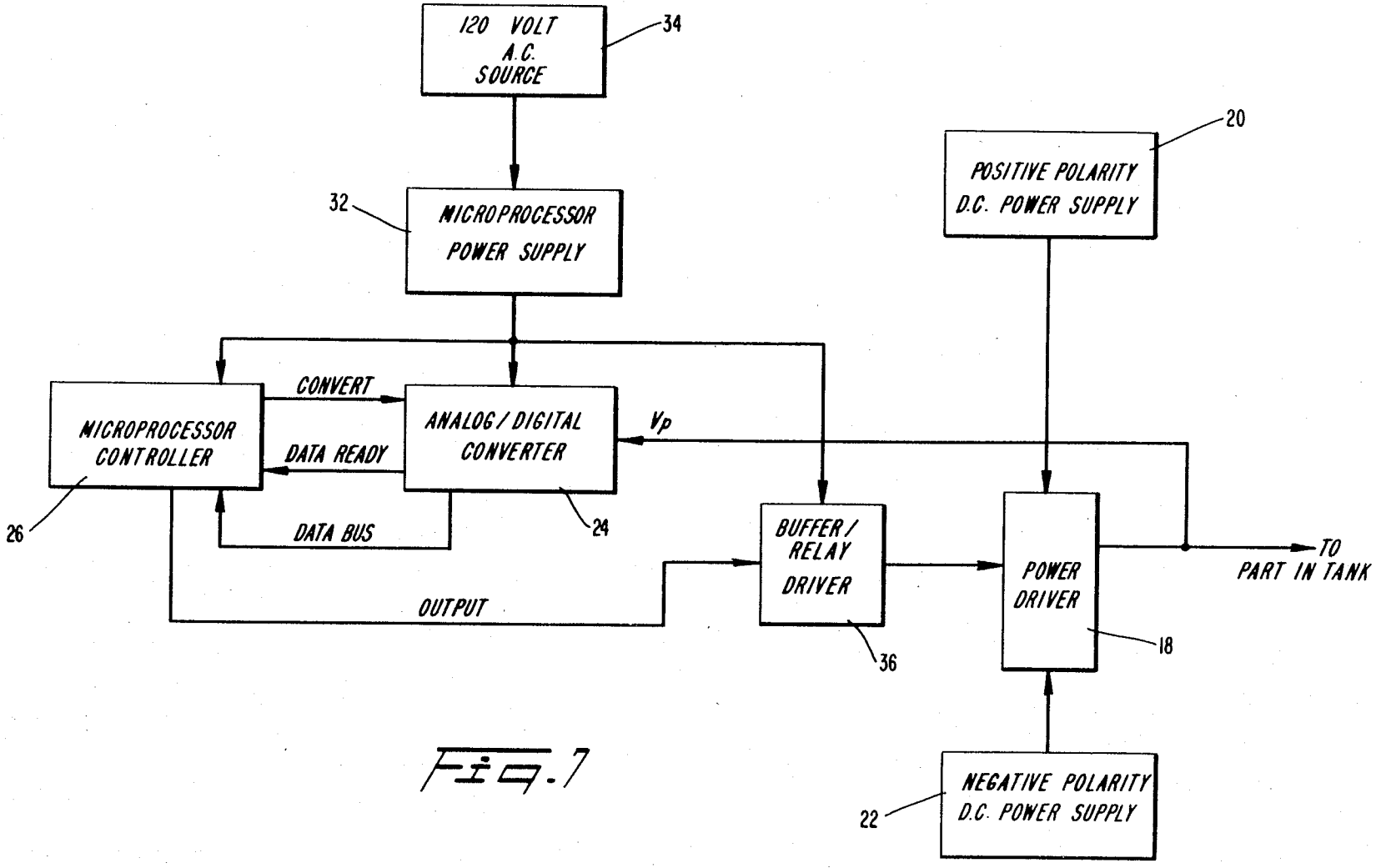
FIG. 7 is a more detailed block diagram of the apparatus in accordance with one embodiment of the present invention.
Figure 8:
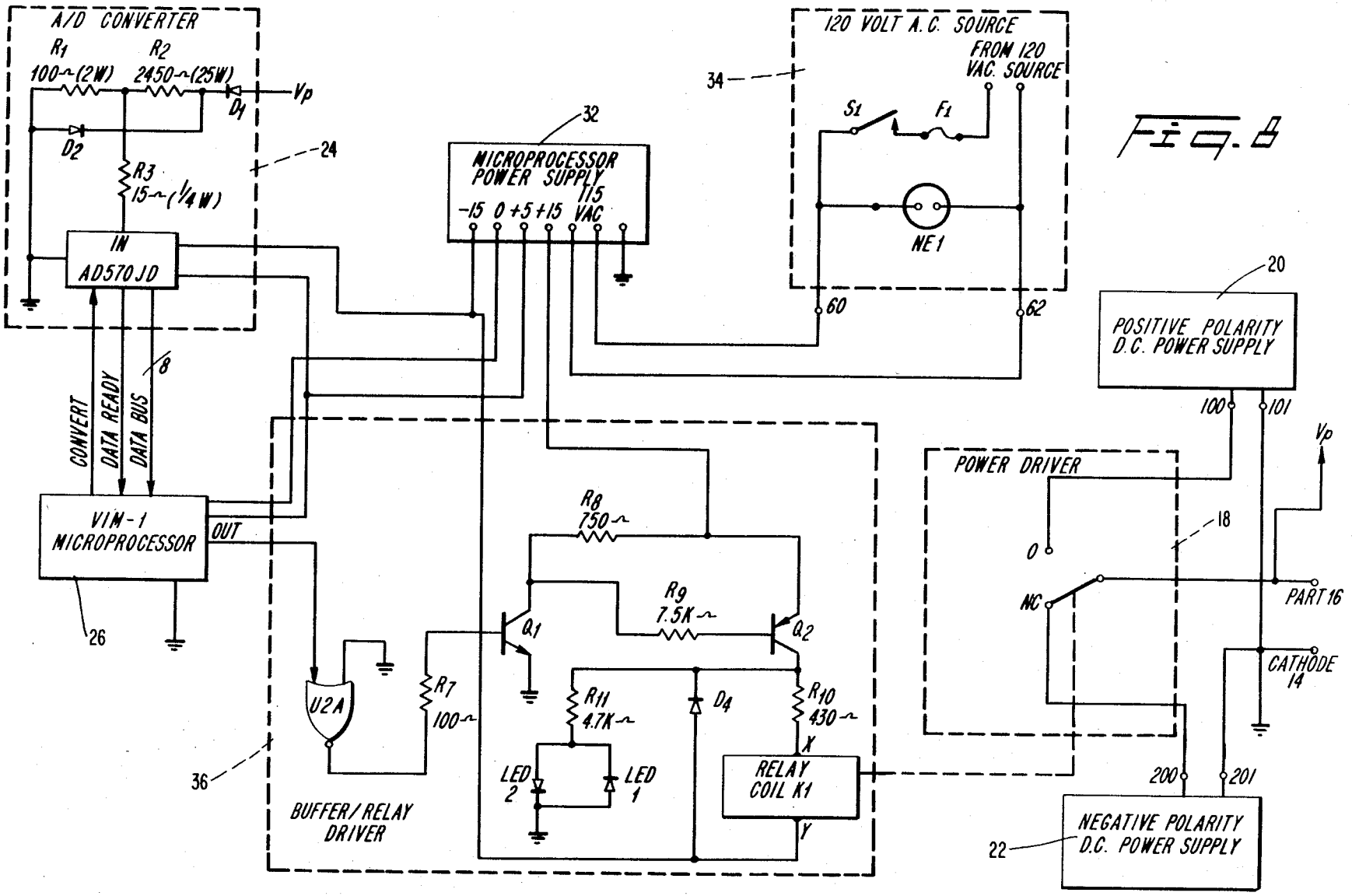
FIG. 8 is an electrical schematic of one embodiment of the present invention.

FIG. 7 is a block diagram showing the process signal flow in a preferred embodiment of the present invention. FIG. 8 is a more detailed electrical circuit diagram showing the interconnections of the blocks in FIG. 7. In a preferred embodiment, the microprocessor controller 26 is the VIM-1 microprocessor as noted previously. The microprocessor is powered by a microprocessor power supply 32 which in this embodiment is a regulated power supply, Model LOT-W-5152-A manufactured by Lambda Electronics Corporation, 599 North Mathilda #210, Sunnyvale, Calif. 94086.

An unregulated 120 volt AC source provides power to the microprocessor power supply 32 which in turn supplies power not only to the microprocessor controller 26 but to the analog-to-digital converter 24 which in a preferred embodiment includes an integrated circuit, Model AD570JD, manufactured by Analog Devices, Inc., Route 1, Industrial Park, P.O. Box 280, Norwood, Mass. 02062. The A/D converter IC and its associated circuitry include R1, R2, R3, D1 and D2 comprises the analog-to-digital converter 24. The microprocessor power supply also supplies power to buffer/relay driver 36.

As can be seen in the electrical schematic of FIG. 8, the 120 volt AC source 34 is connected to an external source of AC voltage and includes an in-line fuse F1, an on-and-off power switch S1 and a neon bulb NE1 used as a power-on indicator. Terminals 60 and 62 provide a 120 volt AC output to drive the microprocessor power supply. The buffer/relay driver 36 includes OR-GATE-IC No. 74128 which has four gates thereon, one of which (U2A) is used. A low current-binary signal of 0 to +5 volts from the microprocessor is applied to the buffer/relay driver which amplifies the signal through transistors Q1 and Q2. Q2 and R10 comprise the relay driver for coil K1 providing an output of either −15 volts or about +9 volts. This output is connected to the high side of coil K1 (shown as terminal X).

The output of the OR gate U2A is fed through a base current limiting resistor R7 to the base of switching transistor Q1 which in one embodiment may be a 2N2219 transistor which inverts and increases the voltage level of the pulse signal. This amplified signal from Q1 then drives output transistor Q2 which in one embodiment may be a 2N2905A transistor with the emitter connected to the +15 volt terminal on the microprocessor power supply 32 and a resistor R10 and coil K1 in series with its collector. It should be understood that relay driver coil K1 and relay switch RS1 are actually one device which in one embodiment may be a single pole, double throw (SPDT) relay, having a 24 volt, 160 ohm coil activation input. The d.c. relay used in one embodiment was a Type 1222-DED relay manufactured by the Leach Corporation, 5915 Avalon Boulevard, Los Angeles, Calif. 90003.

Also connected to the collector of Q2 through series resistor R11 are back-to-back light emitting diodes LED1 and LED2 which are connected to ground. Light emitting diodes LED1 and LED2 are activated depending on the polarity of the high side of coil K1 to indicate the same during the duty cycle of the output signal. The low side of coil K1 (shown as terminal Y) is connected to the −15 volt terminal on the microprocessor power supply 32.

Across the coil K1, at terminals X and Y, is a diode which in one embodiment may be a 1N5618 diode installed in the reverse current direction to protect the circuitry from the kick-back voltage from coil K1.

Power driver 18 effectively provides a high-current, high-voltage amplification to the coil K1 input signal and provides an output signal voltage which is applied to the anodizing part 16 with the cathode 14 grounded. The process voltage $V_p$ is fed back to the A/D converter 24 and applied to the microprocessor in digital form on the 8-line data bus.

The power driver 18 is supplied with current-regulated positive and negative power supplies 20 and 22 as indicated in FIGS. 3, 7 and 8. The positive power supply provides a voltage up to +100 volts and 15 amps DC with the negative power supply providing a voltage up to −50 volts and 5 amps DC. The positive (+) and negative (−) terminals of power supply 20 are connected to terminals 100 and 101, respectively. The negative (−) and positive (+) terminals of power supply 22 are connected to terminals 200 and 201, respectively.

A zero volt input signal from the microprocessor 26 will turn off Q1 and Q2 will serve as an open switch causing the high side of coil K1 (terminal X) to have a −15 volt potential and the low side of coil K1 (terminal Y) will also have a −15 volt potential. The net potential across coil K1 is then zero volts and the relay switch RS1 remains in the normally closed (NC) position and current is drawn from the negative polarity power supply 22 through power driver 18 to part 16. A +5 volt signal from the microprocessor will turn on Q1, providing a path for Q2 base current to flow. Then Q2 will serve as a closed switch and the collector of Q2 will have a +15 volt potential. The low side of coil K1, being connected to the microprocessor power supply 32, will have a −15 volt potential. Hence, the potential across the collector of Q2 and the low side of coil K1 will be +30 volts. Now the current limiting resistor R10 causes a voltage drop of about 6 volts to the high side of coil K1, such that the net potential across coil K1 is about +24 volts. Coil K1 is thereby energized and RS1 is switched from the normally closed (NC) position to the open (0) position, thereby drawing current from the positive polarity power supply 20 through power driver 18 and applying the current to part 16.

As noted previously, the parameters V1 and V2 can be adjusted to the optimum levels for a particular production system, the breakdown voltage expected, the current density desired, etc. Although a preferred embodiment of the present invention teaches the use of phases a, b and/or c in order, it can be seen that other combinations of phases a, b and c and/or other obvious waveforms in view thereof may be utilized. It will be obvious to one of ordinary skill in the art that if the waveform is to be varied from that specifically disclosed in FIG. 2*b*, the flow chart of FIGS. 5–8 would be suitably amended. The major criteria is that, as the coating thickness increases (increasing the gas path and the heat to be dissipated), the time ratio of forward to reverse power is gradually decreased.

Although the invention has been described relative to a specific embodiment thereof, it is not so limited and many modifications and variations thereof will be readily apparent to those skilled in the art in light of the above teachings. It is, therefore, to be understood that, within the scope of the appended claims, the invention may be practiced otherwise than as specifically described.

The embodiments of an invention in which an exclusive property or privilege is claimed are defined as follows:

1. A method for electroprocessing the surface of a metal, said method comprising the steps of:

immersing said metal surface and an electrode means in an electrolyte:

flowing anodizing and degassing current pulses between said surface and said electrode means, said anodizing and degassing current pulses having pulse widths defining anodizing and degassing time durations respectively which define an anodizing to degassing time ratio, said anodizing pulses being of a polarity which causes said metal surface to be anodic with respect to said electrode means and said degassing pulses being of a polarity opposite to that of the anodizing pulses or of a zero magnitude wherein the flowing of said anodizing and degassing current pulses results in a process voltage $V_p$ between said metal surface and said electrode means;

sensing the process voltage $V_p$ during the flowing of said anodizing and degassing current pulses and varying said time ratio by means of a preprogrammed microprocessor responsive to the sensed process voltage $V_p$ to maintain the process voltage $V_p$ at a level below a predetermined burn voltage $V_b$.

2. The method of claim 1, wherein said electroprocessing comprises anodizing of aluminum, said metal surface contains aluminum, and said anodizing pulses comprise current pulses of a polarity which effects anodization of said aluminum.

3. The method of claim 2, wherein said degassing current pulses comprise a zero magnitude pulse of variable duration.

4. The method of claim 2, wherein said anodizing and degassing pulses are of a generally constant current magnitude and have a variable time duration.

5. The method of claim 2, wherein said anodizing and degassing current pulses are direct current pulses of opposite polarity.

6. The method of claim 5, wherein said varying step comprises the step of decreasing said anodizing to degassing time ratio.

7. The method of claim 6, wherein said decreasing step includes the step of increasing the duration of said degassing pulses with respect to said anodizing pulses, while maintaining the magnitude of the anodizing and degassing pulses generally constant.

8. The method of claim 6, wherein said decreasing step includes the step of decreasing the duration of anodizing pulses while maintaining the magnitude of the anodizing and degassing pulses generally constant.

9. The method of claim 6 further including the step of reducing the magnitude of the anodizing pulses while maintaining the duration of the anodizing and degassing pulses generally constant.

10. The method of claim 6, wherein said current flowing step comprises a conditioning step during which anodizing and degassing pulses of generally constant magnitude and duration flow between said electrode means and said metal surface.

11. The method of claim 6 or 10, wherein said current flowing step includes an anodizing step having at least two phases, both of which comprise flowing generally constant magnitude current pulses, a first of said phases comprising an increase in degassing time duration and a second of said phases comprising a decrease in anodizing time duration.

12. The method of claim 11, wherein said varying step further includes a third phase after said two phases in which said anodizing and degassing pulse durations remain constant and said anodizing pulse current magnitude decreases.

13. The method of calim 11, wherein said varying step further includes the steps of:

sensing the process voltage $V_p$ between said metal surface and said electrode means during an anodizing pulse; and changing phases when said process voltage $V_p$ reaches a predetermined transition voltage $V_f$.

14. A method according to claim 13, wherein if said process voltage is less than a first threshold voltage $V_1$, the microprocessor controls said current flowing step to apply a preset conditioning cycle comprising anodizing and degassing pulses wherein said time ratio is at a maximum; and if said voltage is greater than $V_1$ said microprocessor controls said current flowing step to apply an anodizing cycle comprising anodizing and degassing pulses wherein said time ratio decreases with time.

15. The method of claim 14, wherein $V_1$ is adjustable depending upon the metal surface being anodized.

16. The method of claim 14, wherein if said process voltage is between $V_1$ and $V_f$, said microprocessor applies said first phase of anodizing pulses and if said process voltage is between $V_f$ and a second threshold voltage $V_2$, said microprocessor applies said second phase of anodizing pulses.

17. The method of claim 16, wherein $V_f$ and $V_2$ are adjustable depending upon the metal surface being anodized.

18. An apparatus for electroprocessing a metal surface, said apparatus comprising:

means for providing an electrolyte bath in which said metal surface is immersible;

circuit means, including an electrode at least partially immersed in said bath, for flowing anodizing and degassing current pulses, which define anodizing and degassing time durations respectively, to said metal surface so as to produce a hard coating of increasing thickness on said surface, said anodizing to degassing time duration defining a time ratio, said anodizing pulses being of a polarity which causes said metal surface to be anodic with respect to said electrode and said degassing pulses being of a polarity opposite to that of the anodizing pulses or of a zero magnitude;

means for sensing a process voltage $V_p$ between said metal surface and said electrode resulting from said current pulses; and means responsive to said process voltage for varying said time ratio to maintain said process voltage, $V_p$, below a predetermined burn voltage $V_b$, said varying means comprising a preprogrammed microprocessor programmed to implement an electroprocessing cycle having at least one phase.

19. The apparatus of claim 18, wherein said apparatus is an anodizing apparatus, said metal surface contains aluminum, and said anodizing pulses are of a polarity which causes anodization of said aluminum and said electroprocessing cycle is an anodizing cycle.

20. The apparatus of claim 19, wherein said circuit means comprises:

power driver, responsive to said microprocessor, for causing anodizing pulses and degassing pulses of a predetermined magnitude to flow between said electrode means and said metal surface, said degassing pulses comprising one of zero current pulses or current pulses of opposite polarity to said anodizing pulses.

21. The apparatus of claim 20, wherein said microprocessor is preprogrammed to reduce said anodizing to degassing time ratio during said anodizing cycle.

22. The apparatus of claim 21, wherein said degassing pulses comprise current pulses of opposite polarity to that of said anodizing pulses.

23. The apparatus of claims 18, 19, 20, 21 or 22, wherein said microprocessor is responsive to said process voltage during an anodizing pulse to vary said time ratio.

24. The apparatus of claim 22, wherein said power driver comprises:

first means for supplying anodizing pulses of a generally constant current magnitude;

second means for supplying degassing pulses of a generally constant current magnitude; and switching means, responsive to said microprocessor, for flowing current from one of said first or second means to said metal surface.

25. The apparatus of claim 24, wherein said microprocessor is supplied with $V_p$, $V_1$, $V_2$, $(T_{pos})_{max}$, $(T_{neg})_{max}$, $(T_{pos})_{min}$, $(T_{neg})_{min}$ and $V_f$ wherein:

$V_p$ = the variable process voltage during a preceding anodizing pulse;

$V_1$ = minimum process voltage at which control is to begin;

$V_2$ = maximum desired process voltage;

$(T_{pos})_{max}$ = maximum duration of any anodizing pulse;

$(T_{neg})_{max}$ = maximum duration of any degassing pulse;

$(T_{pos})_{min}$ = minimum duration of any anodizing pulse;

$(T_{neg})_{min}$=minimum duration of any degassing pulse; and $V_f$=an intermediate voltage between $V_1$ and $V_2$;

said microprocessor being operable to control said power driver to provide variable forward and reverse pulse duration $T_{pos}$ and $T_{neg}$, respectively, to said metal surface where:

$$\text{when } V_p \leqq V_1;\ T_{pos} = (T_{pos})_{max} \text{ and } T_{neg} = (T_{neg})_{min}$$

$$V_1 < V_p \leqq V_f;\ T_{pos} = (T_{pos})_{max} \text{ and } T_{neg} = \frac{2(T_{neg})_{max}(V_p - V_1)}{(V_2 - V_1)}$$

$$V_f < V_p < V_2;\ T_{pos} = \frac{2(T_{pos})_{max}(V_2 - V_p)}{(V_2 - V_1)} \text{ and } T_{neg} = (T_{neg})_{max}$$

$$V_p \geqq V_2;\ T_{pos} = (T_{pos})_{min} \text{ and } T_{neg} = (T_{neg})_{max}.$$

26. The apparatus of claim 24, wherein said microprocessor is operable to control the current flowing from said power driver to said metal surface to implement a conditioning cycle wherein said anodizing and degassing pulses have generally constant magnitude and duration, and to implement an anodizing cycle having at least two phases, a first phase being characterized by an increasing degassing pulse duration and a second phase being characterized by a decreasing anodizing pulse duration, said microprocessor changing from said conditioning cycle to said anodizing cycle after a preset period of time and changing from said first phase to said second phase when said process voltage $V_p=V_f$, where:

$V_p$=the process voltage during a preceding anodizing pulse;

$V_1$=minimum process voltage at which control is to begin;

$V_2$=maximum desired process voltage; and $V_f=V_1+V_2-V_1/2$.

27. The apparatus of claim 22 further including an analog to digital converter for monitoring said process voltage and inputting said monitored voltage to said microprocessor.

28. A method for electroprocessing the surface of a metal, said method comprising the steps of:

immersing said metal surface and an electrode means in an electrolyte;

flowing forward and non-forward current pulses between said surface and said electrode means, said forward and non-forward current pulses having pulse widths defining forward and non-forward time durations respectively which define a forward to non-forward time ratio, said forward pulses being of a polarity which causes ions in said electrolyte to plate onto said metal surface and said non-forward pulses being of a polarity opposite to said forward pulses or of a zero magnitude wherein the flowing of said forward and non-forward current pulses results in a process voltage $V_p$ between said metal surface and said electrode means;

sensing the process voltage $V_p$ during the flowing of said forward and non-forward current pulses; and varying said time ratio by means of a preprogrammed microprocessor responsive to the sensed process voltage $V_p$ to maintain the process voltage $V_p$ at a level below a voltage $V_b$.

29. An apparatus for electroplating a metal surface, said apparatus comprising:

an electrolyte bath in which said metal surface is immersible;

circuit means, including an electrode at least partially immersed in said bath, for flowing forward and non-forward current pulses, which define forward and non-forward time durations respectively, to said metal surface so as to produce a hard coating of increasing thickness on said surface, said forward to non-forward time duration defining a time ratio, said forward pulses being of a polarity which causes ions in said electrolyte bath to plate onto said metal surface and said non-forward pulses being of a polarity opposite to that of the forward pulses or of a zero magnitude;

means for sensing a process voltage $V_p$ between said metal surface and said electrode resulting from said current pulses; and means responsive to said process voltage for varying said time ratio to maintain said process voltage, $V_p$, below a predetermined voltage $V_b$, said varying means comprising a preprogrammed microprocessor programmed to implement an electroplating cycle having at least one phase.

* * * * *